US006473367B2

(12) United States Patent
Peng

(10) Patent No.: US 6,473,367 B2
(45) Date of Patent: Oct. 29, 2002

(54) POSITIONING MECHANISM FOR A RADIO CLOCK

(76) Inventor: Koung-Chung Peng, 2F, No. 50, Lane 467, Section 3, Tong Da Road, Hsinchu City (TW)

( * ) Notice: Subject to any disclaimer, the term of this patent is extended or adjusted under 35 U.S.C. 154(b) by 0 days.

(21) Appl. No.: 09/738,825

(22) Filed: Dec. 15, 2000

(65) Prior Publication Data

US 2002/0075762 A1 Jun. 20, 2002

(51) Int. Cl.[7] ..... G04C 11/02; G04C 9/00
(52) U.S. Cl. ..... 368/47; 368/79; 368/239
(58) Field of Search ..... 368/47, 239, 79, 368/187

(56) References Cited

U.S. PATENT DOCUMENTS 4,290,131 A * 9/1981 Kume et al. ..... 368/239
4,420,263 A * 12/1983 Besson et al. ..... 368/187
4,645,357 A * 2/1987 Allgaier et al. ..... 368/187
5,231,612 A * 7/1993 Allgaier et al. ..... 368/47
5,270,993 A * 12/1993 Besson et al. ..... 368/187
5,363,348 A * 11/1994 Damle ..... 368/47
5,418,362 A * 5/1995 Lusby et al. ..... 250/231.18
5,898,644 A * 4/1999 Ganter et al. ..... 368/187

* cited by examiner

*Primary Examiner*—Vit Miska
*Assistant Examiner*—Jeanne-Marguerite Goodwin

(57) ABSTRACT

A radio clock, which is a mechanical clock with an hour hand, a minute band a second hand driven by motors, comprises an antenna, a receiving circuit, and a processor to receive timing information as the reference time for time setting. An hour pinion, minute pinion, and a second pinion are engaged respectively with an hour transmission pinion, a minute transmission pinion, and a second transmission pinion. The hour transmission pinion, the minute transmission pinion, and the second transmission pinion are provided, respectively, with an hour masking disc, a minute masking disc, and a second masking disc, wherein the hour masking disc, the minute masking disc, and the second masking disc are provided with protruded masking fins, respectively. The transmission pinions are configured to close to their corresponding masking discs. When the radio clock actuates its time-setting function, a photoelectric sensor which is employed to detect the hour masking fin, the minute masking fin, and the second masking fin and determine whether the hour hand, the minute hand, and the second hand reach their expected positions.

6 Claims, 4 Drawing Sheets

(A) (PRIOR ART)

(B) (PRIOR ART)

POSITIONING MECHANISM FOR A RADIO CLOCK

BACKGROUND OF THE INVENTION

1. Field of the Invention

The present invention relates to a radio clock and, in particular, to a clock which employs a photoelectric element to determine whether the hour pinion, the minute pinion, and the second pinion reach their position points, and to be able to quickly complete the positioning of the hour hand, the minute hand, and the second hand.

2. Description of the Prior Art

Radio clocks can receive the timing information sent from an emitting station, and the information can be used as a reference time on time setting. Referring to FIG. 1, a radio clock typically comprises an antenna 11, a receiving circuit 12, and a processor 13. The receiving circuit 12 receives the timing information sent from an emitting station by the antenna 11, and then the receiving circuit 12 transmits the information to the processor 13, which controls and handles the process of time setting. In general, when the time-setting function of a radio clock is actuated, the hour hand, the minute hand, and the second hand will be controlled and moved to the position points which typically is the zero (twelve) o'clock, zero minute, and zero second. The hour hand, the minute hand, and the second hand will then be adjusted to the position corresponding to the received timing information. A positioning mechanism is needed for moving the hour hand, the minute hand, and the second hand to the position points in a controlled manner. For a mechanic radio clock whose hour pinion, minute pinion, and second pinion are driven by motors, the positioning mechanism employs photoelectric elements to determine whether the hour pinion, the minute pinion, and the second pinion reach the position points. Referring to FIG. 1 again, the radio clock employs two motors 14, 15 to drive the second pinion and the minute pinion respectively, and employs then the minute pinion to drive the hour pinion. In this way, the hour hand, the minute hand, and the second hand can be moved in a controlled manner. Two photoelectric elements are also employed to carry out the positioning of the hour hand, the minute hand, and the second hand by detecting the identifying position points on the hour pinion and the second pinion as shown in FIG. 2. In FIG. 2, only the hour hand and the minute hand are shown, the photoelectric element 16 is employed to detect the position point 17 of the hour pinion 18. When the photoelectric element 16 detects the position point 17, the hour hand and the minute hand corresponding to the hour pinion 18 and the minute pinion 19 should be located at the zero (twelve) o'clock and zero minute. The positioning of the second hand also employs the same technique, i.e. a photoelectric element is employed to detect the identifying position point on the second pinion. In this way, the photoelectric elements can determine whether the hour hand, the minute hand, and the second hand are located at the position points. It is now considered that, when the radio clock actuates the time-setting function at one o'clock and zero minute, the second pinion can reach its position point of zero o'clock after rotating at most one round (assume the second pinion to be at zero o'clock just before the time setting starts) and the minute pinion shall rotate eleven rounds before driving the hour pinion to the position point of zero o'clock. Obviously, it is time consuming for a traditional radio clock to carry out the positioning of the hour hand, the minute hand, and the second hand. If a positioning mechanism can be developed to quickly drive the hour hand, the minute hand, and the second hand to the position points by employing only one photoelectric element, the cost can be cut down and the reduction in time bears positive meaning.

SUMMARY OF THE INVENTION

The object of the present invention is to provide a radio clock which can quickly complete the positioning of the hour hand, the minute hand, and the second hand.

The other object of the present invention is to provide a positioning mechanism which employs only one photoelectric element in determining whether the hour hand, the minute hand, and the second hand reach the position points, when the time-setting function of the radio clock is actuated.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE INVENTION

Figure 1:
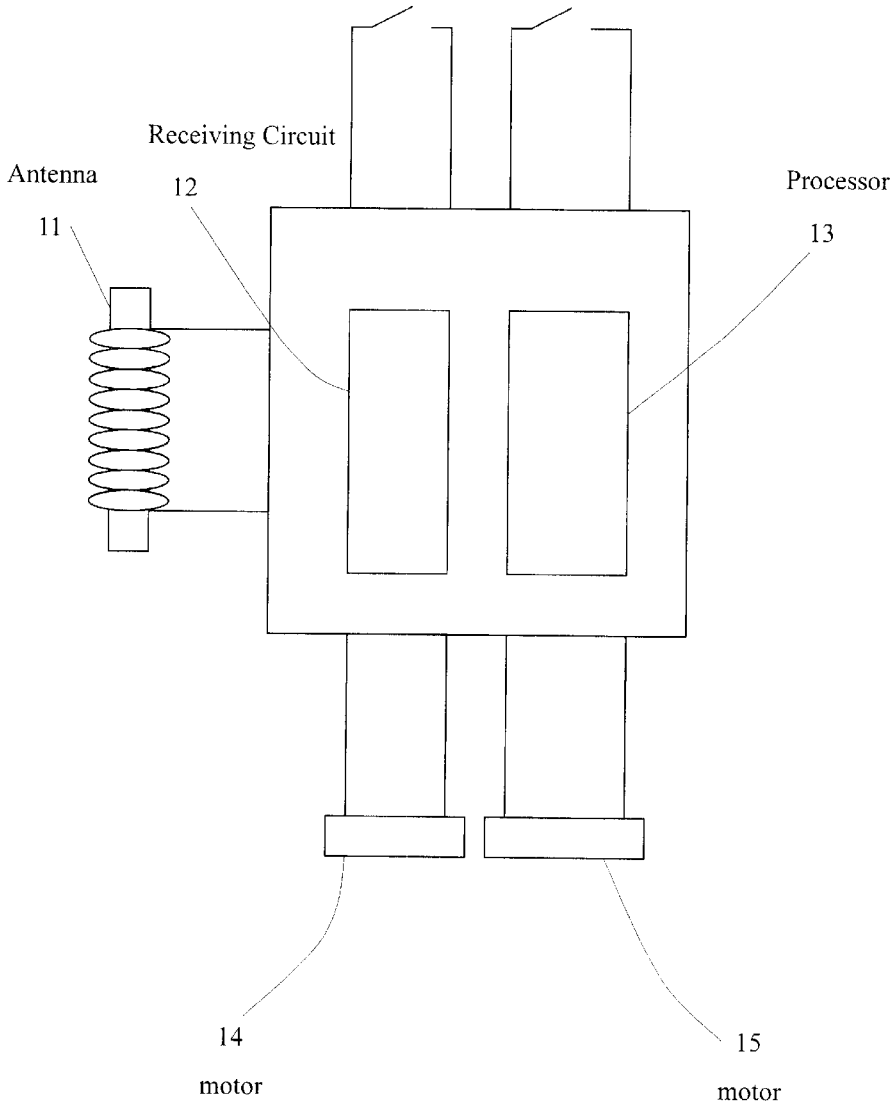
FIG. 1 (PRIOR ART)
FIG. 1 is the schematic illustration of the structure of a radio clock.
Figure 2:
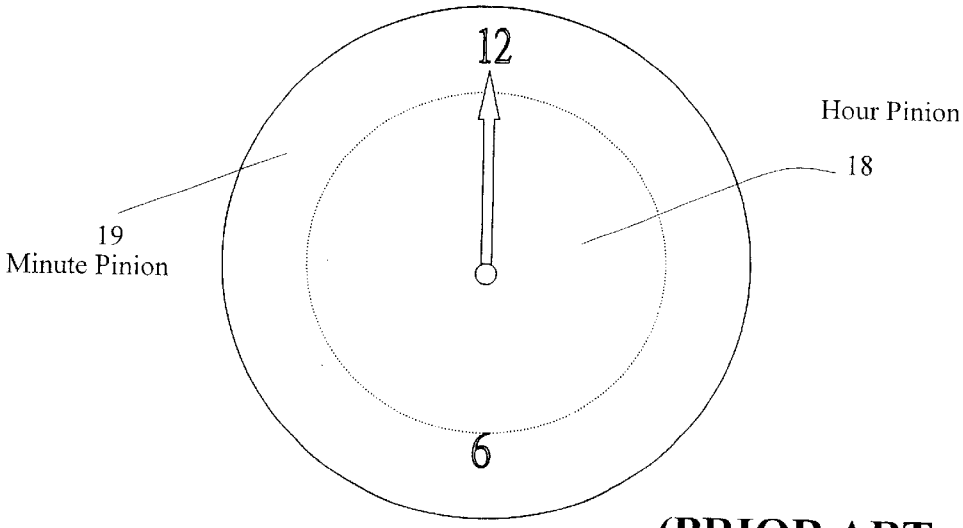
FIG. 2 is the schematic illustration of the positioning mechanism structure of a traditional radio clock.
Figure 2:
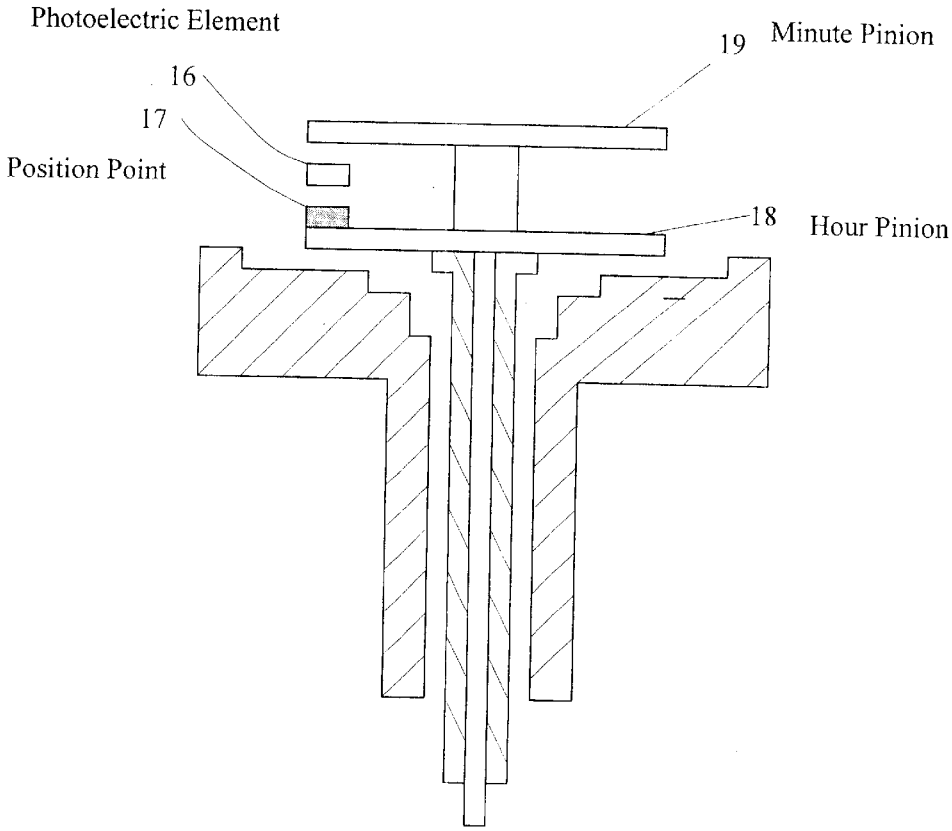
Figure 3:
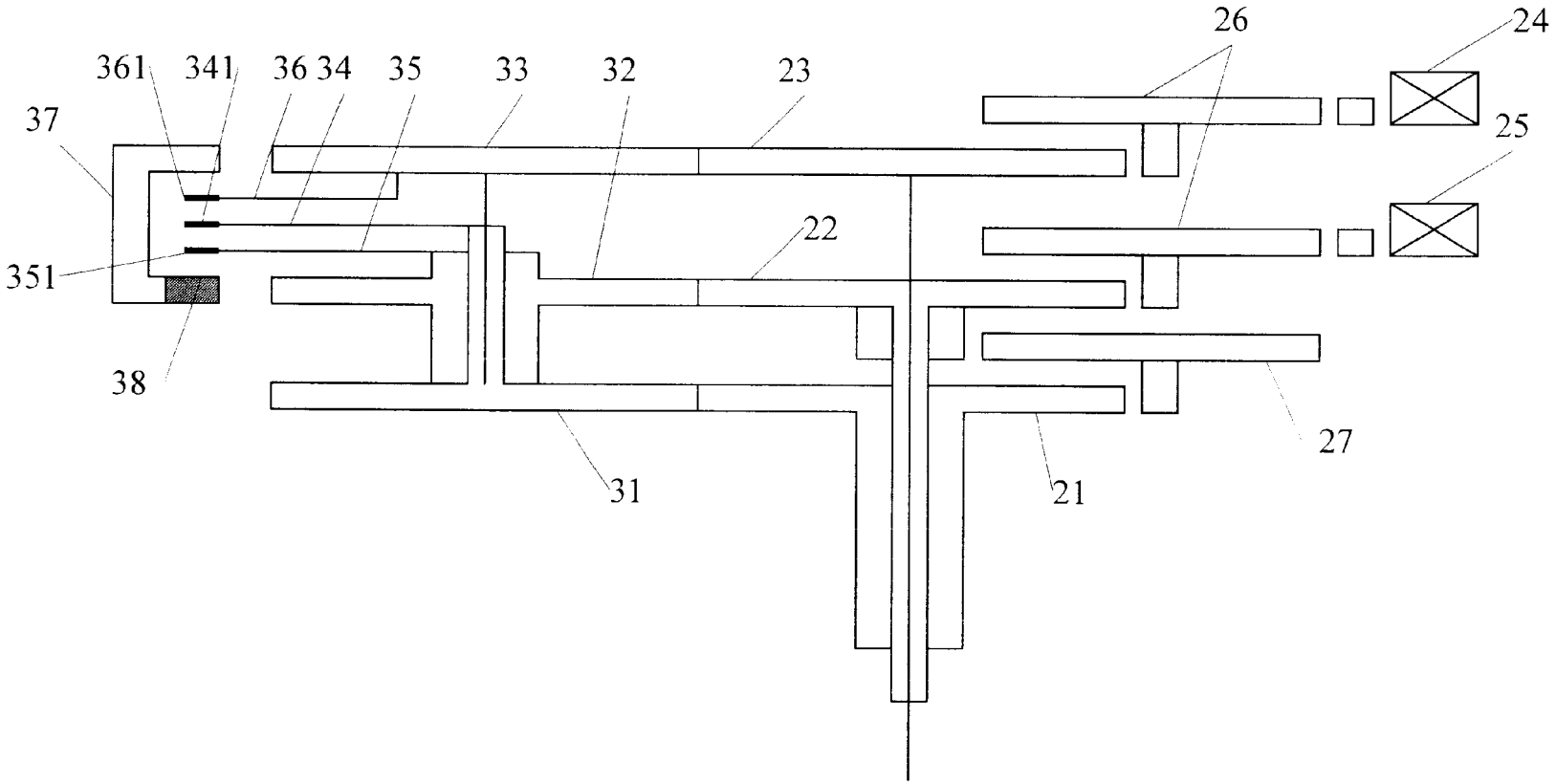
FIG. 3 is the schematic illustration of the positioning mechanism structure of the radio clock in the present invention.

The hour hand, the minute hand, and the second hand of the radio clock of the present invention are driven by pinions in a way similar to those of a traditional mechanical clock. When the time-setting function of a radio clock is actuated, the positioning mechanism employs a photoelectric element to determine whether the hour hand, the minute hand, and the second hand reach the position points. Referring to FIG. 3, the characteristic of the present invention is that three other transmission pinions driven respectively by the hour pinion, the minute pinion, and the second pinion are used by the photoelectric element to determine whether the hour pinion, the minute pinion, and the second pinion are located at the position points.

This invention relates to a radio clock comprising an hour pinion 21, a minute pinion 22, and a second pinion 23 driven by rotors 26, which in turn are driven by motors. Among them, the second pinion 23 rotates after being driven by the rotor 26, which is in turn driven by a motor 24; the minute pinion 22 rotates after being driven by the rotor 26, which is in turn driven by a motor 25 and the hour pinion 21 rotates after being driven by the reduction pinion 27, which is in turn driven by the minute pinion 22. In this manner, the hour pinion, the minute pinion, and the second pinion can drive their corresponding hands, i.e. the hour hand, the minute hand, and the second hand respectively.

The hour pinion 21, the minute pinion 22, and the second pinion 23 are engaged with the hour transmission pinion 31, the minute transmission pinion 32, and the second transmission pinion 33, respectively. The hour transmission pinion 31, the minute transmission pinion 32, and the second transmission pinion 33 are provided, respectively, with an hour masking disc 34, a minute masking disc 35, and a second masking disc 36, wherein the hour masking disc 34, the minute masking disc 35, and the second masking disc 36 are provided with masking fins 341, 351, 361, respectively. The hour masking disc 34, the minute masking disc 35, and the second masking disc 36 are thin slices and configured to be close to their corresponding transmission pinions.

The optical path of the photoelectric sensor 37 can detect the hour masking fin 341, the minute masking fin 351, and the second masking fin 361. The photoelectric sensor 37 includes a receiver 38, and the photoelectric sensor 37 may emit light to the receiver 38. When the receiver 38 receives the optical path from the photoelectric sensor 37, the receiver 38 maintains one electric potential (low electric potential); otherwise, the receiver 38 changes to high potential status. In the present invention, the method used to determine whether the pinions reach the position points is by employing the masking fins 341, 351, 361 to block the optical path of the photoelectric sensor 37 from coming into the receiver 38.

When the hour masking fin 341, the minute masking fin 351, and the second masking fin 361 block the optical path of the photoelectric sensor 37, the hour hand, the minute hand, and the second hand are located at the position points. It is very difficult for a traditional pinion-driven clock to employ only one photoelectric element in the positioning mechanism. Therefore, in the present invention, the hour pinion 21, the minute pinion 22, and the second pinion 23 are engaged with the hour transmission pinion 31, the minute transmission pinion 32, and the second transmission pinion 33, respectively. The hour transmission pinion 31, the minute transmission pinion 32, and the second transmission pinion 33 are provided, respectively, with the hour masking disc 34, the minute masking disc 35, and the second masking disc 36, wherein the hour masking disc 34, the minute masking disc 35, and the second masking disc 36 are provided with masking fins 341, 351, 361, respectively. The hour masking disc 34, the minute masking disc 35, and the second masking disc 36 are configured to be close to their corresponding transmission pinions. The photoelectric sensor 37 can detect the protruded hour masking fin 341, the minute masking fin 351, and the second masking fin 361, and therefore only one photoelectric element is sufficient to determine whether the hour hand, the minute hand, and the second hand reach the position points.

Figure 4:
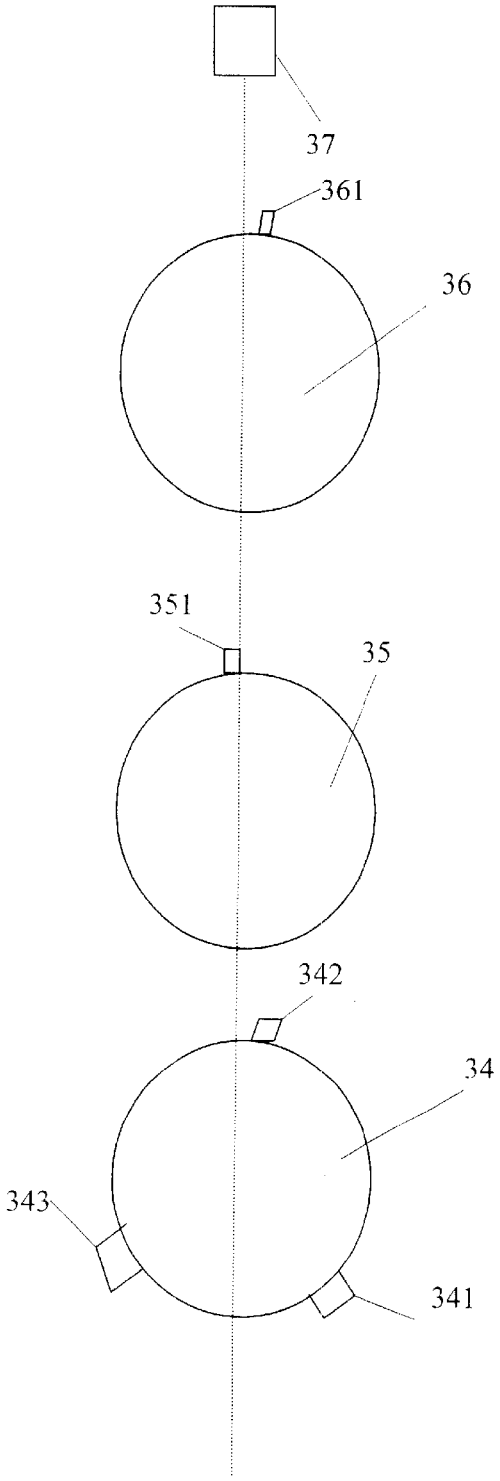
FIG. 4 is the schematic illustration of the procedures for positioning the hour pinion, the minute pinion, and the second pinion when the time setting function of the radio clock is actuated in the present invention.

Referring to FIGS. 3 and 4, the present invention employs only one photoelectric sensor to determine whether the hour hand, the minute hand, and the second hand reach their expected position. Since the photoelectric sensor 37 can only detect a fixed position, it cannot detect the hour masking fin 341, the minute masking fin 351, and the second masking fin 361 at the same time. Therefore, when the photoelectric sensor 37 carries out the positioning by detecting the hour masking fin 341, the minute masking fin 351, and the second masking fin 361, the photoelectric sensor 37 has to detect the hour masking fin 341, the minute masking fin 351, and the second masking fin 361 one by one to complete the positioning. One embodiment of the present invention, the second masking fin 361 is first detected. When the second masking fin 361 is detected, the second masking fin 361 will stop after rotating some distance (i.e. some seconds) to leave the detecting position of the photoelectric sensor 37. The positioning of the second hand is thus finished. Then, the hour/minute motor 25 starts to drive the minute pinion 22. When the photoelectric sensor 37 starts to detect the hour masking fin 341 and the minute masking fin 351, the photoelectric sensor 37 will first detect the hour masking fin 341 and then the minute masking fin 351 in determining whether the hour/minute pinion reaches its expected position. The positioning of the hour/minute pinion is thus finished. In this manner, only one photoelectric element is sufficient to carry out the positioning of the hour hand, the minute hand, and the second hand.

To quickly carry out the positioning of the hour hand, the minute hand, and the second hand in the present invention, the hour masking disc 34 is provided with the first hour masking fin 341, the second hour masking fin 342, and the third hour masking fin 343 as shown in FIG. 4. When the first hour masking fin blocks the position of the photoelectric sensor 37, its corresponding hour hand is situated at the first position point (assume it to be twelve o'clock); similarly, the second hour masking fin is situated at the second position point (four o'clock position); the third hour masking fin is situated at the third position point (eight o'clock position).

Because the time for the optical path being blocked by the first hour masking fin 341, the second hour masking 342, and the third hour masking fin 343 are different due to their different widths, the processor can determine which masking fin is blocking the optical path, and subsequently which position point its corresponding hour hand is located. In this manner, the positioning of the hour hand and the minute hand can be quickly completed. Assume, for example, the time-setting function to be actuated at one o'clock, the radio clock will stop timekeeping immediately. And in the mean time, the photoelectric sensor 37 starts to detect the hour masking disc, the minute masking disc, and the second masking disc.

If the hour masking disc, the minute masking disc, and the second masking disc can not be detected, then the hour/minute pinion 25 will stop rotating, and the second pinion 23 driven by the second motor 24 will continuously rotate one round. The second masking fin 361 which corresponds to the second pinion 23 will also rotate one round before blocking the optical path of the photoelectric sensor 37, which in turn sends a signal to stop the rotating of the motor 24. But the second masking fin 361 will rotate a little further to move out of the optical path before stopping. The optical path of the photoelectric sensor 37 can then be blocked by the hour masking fin and the minute masking fin. When the second hand reaches its position point, the motor 25 will drive the minute pinion 22 and the photoelectric sensor 37 starts to detect the hour masking disc 34.

After the minute pinion 22 rotates three rounds, the second hour masking fin 342 of its corresponding hour masking disc 34 will block the optical path of the photoelectric sensor 37, and the processor can then detect that the hour hand reaches the position of four o'clock by the second hour masking fin's 342 blocking the optical path. Then the photoelectric sensor 37 will detect the minute masking fin 351 and subsequently send a signal to stop the motor 25. The positioning of the hour hand, the minute hand, and the second hand is thus completed, and the processor is informed that the hour hand is located at four o'clock and the minute and the second hands are located at zero (twelve) o'clock. Later on, when the processor receives the timing information with zero second reading, the processor will immediately actuate the motor 24 to drive the second hand to the position corresponding to the readings of the reference time. In the mean time, the processor directs the motor 25 to drive the hour and the minute hands to the timing information received by the processor. The time setting is thus completed, and the hour, minute, and the second hands will operate normally as ordinary clocks afterwards.

In the present invention, when the radio clock actuates the time-setting function, the minute hand rotates three rounds at most (if actuates at twelve, four, and eight o'clock) to complete the positioning of the hour hand, the minute hand, and the second hand. The time required to complete the positioning for the radio clock in the present invention can be greatly reduced compared with that for a traditional radio clock.

Radio clocks are widely used in Europe and America. The functional circuits of the main receiving circuits and processors can make use of related IC, which will not be described here. The primary feature of the present invention is that the positioning mechanism employs a photoelectric sensor to determine whether the hour pinion, the minute pinion, and the second pinion reach their expected positions. Particularly, The hour, minute, and second pinions are engaged respectively with the hour transmission pinion, the minute transmission pinion, and the second transmission pinion for transmission. The hour transmission pinion, the minute transmission pinion, and the second transmission pinion are provided, respectively, with an hour masking disc, a minute masking disc, and a second masking disc. The transmission pinions are configured to close to their corresponding masking discs. In this manner, only one photoelectric sensor is sufficient to complete the positioning of the hour hand, the minute hand, and the second hand. During the positioning process, the minute hand needs to rotate at most four rounds to reach its position point by use of the three hour masking fins, which are located evenly around the hour masking disc. The time required to complete the positioning here is much shorter than the traditional method. The clock radio of the present invention is therefore commercially viable.

To sum up, this present invention is indeed progressive in nature and highly applicable in industry, and its novelty has met the necessary requirements of the New Model Patent. We, therefore, put forward the application of the present invention for the New Model Patent accordingly and hope sincerely this application could be granted after your review.

It should be understood that the above only describes an example of one embodiment of the present invention, and that various alternations or modifications may be made thereto without departing the spirit of this invention. Therefore, the protection scope of the present invention should be based on the claims described later.

What is claimed is:

1. A radio clock comprising:

an antenna, a receiving circuit and a processor for receiving timing information as reference time for time setting;

an hour pinion, a minute pinion and a second pinion driven by motors, said hour pinion, said minute pinion and said second pinion respectively engaged with an hour transmission pinion, a minute transmission pinion and a second transmission pinion; an hour masking disc, a minute masking disc and a second masking disc respectively attached to said hour transmission pinion, said minute transmission pinion and said second transmission pinion; and at least one hour masking fin formed on said hour masking disc, a minute masking fin formed on said minute masking disc and a second masking fin formed on said second masking disc; and a photoelectric sensor;

wherein said photoelectric sensor detects said at least one hour masking fin, said minute masking fin and said second masking fin to determine whether said hour pinion, said minute pinion and said second pinion reach their expected positions when said radio clock actuates time setting.

2. The radio clock as claimed in claim 1, wherein said photoelectric sensor first detects said second masking fin to complete a positioning of said second pinion, then detects said hour masking fin, and finally detects said minute masking fin to complete a positioning of said hour pinion and said minute pinion when said radio clock actuates time setting.

3. The radio clock as claimed in claim 1, wherein said hour masking disc is formed with a plurality of hour masking fins with different widths.

4. The radio clock as claimed in claim 3, wherein said photoelectric sensor first detects said second masking fin to complete a positioning of said second pinion, then detects an hour masking fin with its width to determine which hour masking fin it is, and finally detects said minute masking fin to complete a positioning of said hour pinion and said minute pinion when said radio clock actuates time setting.

5. The radio clock as claimed in claim 1, wherein said hour masking disc is formed with three hour masking fins with different widths, said three hour masking fins being located evenly around said hour masking disc.

6. The radio clock as claimed in claim 5, wherein said photoelectric sensor first detects said second masking fin to complete a positioning of said second pinion, then detects an hour masking fin with its width to determine which hour masking fin it is, and finally detects said minute masking fin to complete a positioning of said hour pinion and said minute pinion when radio clock actuates time setting.

* * * * *